US005305418A

United States Patent [19]

Tuttle

[11] Patent Number: 5,305,418

[45] Date of Patent: * Apr. 19, 1994

[54] WATER HEATER TANK ARRANGEMENT CONTROL DEVICE AND SHAFT EXTENSION THEREFOR AND METHODS OF MAKING THE SAME

[75] Inventor: James R. Tuttle, Mission Viejo, Calif.

[73] Assignee: Robertshaw Controls Company, Richmond, Va.

[ * ] Notice: The portion of the term of this patent subsequent to Oct. 27, 2009 has been disclaimed.

[21] Appl. No.: 930,750

[22] Filed: Aug. 14, 1992

Related U.S. Application Data

[62] Division of Ser. No. 720,226, Jun. 24, 1991, Pat. No. 5,159,658.

[51] Int. Cl.[5] ..... H05B 1/02; F24H 9/20

[52] U.S. Cl. ..... 392/449; 126/374; 74/553; 464/116; 338/166

[58] Field of Search ..... 392/449–457; 126/361, 374; 74/553, 18, 608; 174/5 R, 66; 122/13.1, 13.2, 494; 116/216, 221, 291, 305; 200/331; 81/177.2; 464/116, 113, 901; 374/208–209; 338/166, 163, 175

[56] References Cited

U.S. PATENT DOCUMENTS

| | | | |
|---|---|---|---|
| 1,537,227 | 5/1925 | DeWitt | 74/553 |
| 2,257,979 | 10/1941 | Rubenstein | 338/166 |
| 2,669,634 | 2/1954 | Daily et al. | 338/166 |
| 2,699,479 | 1/1955 | Gorham | 74/553 |
| 3,382,473 | 5/1968 | Benthuysen et al. | 338/166 |
| 3,955,449 | 5/1976 | Hofmeister et al. | 338/166 |
| 4,011,513 | 3/1977 | Kawachi | 74/10 R |
| 4,435,993 | 3/1984 | Scott | 74/553 |
| 4,453,434 | 6/1984 | Lissy | 74/553 |
| 4,633,211 | 12/1986 | McIntosh | 337/338 |
| 4,739,300 | 4/1988 | Kuratani | 338/166 |
| 5,101,471 | 3/1992 | Bill | 392/449 |

FOREIGN PATENT DOCUMENTS

| | | | |
|---|---|---|---|
| 1037683 | 8/1958 | Fed. Rep. of Germany | 219/449 |

*Primary Examiner*—Bruce A. Reynolds
*Assistant Examiner*—John A. Jeffery
*Attorney, Agent, or Firm*—Candor, Candor & Tassone

[57] ABSTRACT

A water heater tank arrangement, control device and shaft extension therefor and methods of making the same are provided, the water heater tank arrangement comprising a water heater tank having a heating unit therefor, a control device carried by the tank and having an operating unit to sense the temperature of the tank and to operate the heating unit in relation to the sensed temperature and a selected temperature of the control device, the control device having a housing and having a temperature selector unit rotatably carried by the housing to set the selected temperature, the selector unit comprising a knob provided with a transverse slot therein, and a shaft extension having opposed ends one of which has drive structure snap-fitted into the slot so that the knob is adapted to be rotated upon the turning of the other of the ends of the shaft extension.

12 Claims, 2 Drawing Sheets

WATER HEATER TANK ARRANGEMENT CONTROL DEVICE AND SHAFT EXTENSION THEREFOR AND METHODS OF MAKING THE SAME

CROSS REFERENCE TO RELATED APPLICATION

This application is a divisional patent application of its copending parent patent application, Ser. No. 720,226, filed Jun. 24, 1991, now U.S. Pat. No. 5,159,658.

BACKGROUND OF THE INVENTION

1. Field of the Invention

This invention relates to a new combination of a water heater tank and a control device therefor and to such a control device and a shaft extension for the control device as well as a new method of making such a new combination.

2. Prior Art Statement

It is known to provide the combination of a water heater tank having a heating means therefor and a control device carried by the tank and having operating means to sense the temperature of the tank and to operate the heating means in relation to the sensed temperature and a selected temperature of the control device, the control device having a housing means and having a temperature selector means rotatably carried by the housing means to set the selected temperature, the selector means comprising a knob provided with a transverse slot means therein. For example, see the U.S. Pat. to McIntosh, No. 4,633,211.

It is also known to provide a shaft extension to a selector means of a control device. However, it is not known to applicant to snap-fit a shaft extension in a transverse slot means in a knob of a selector means.

SUMMARY OF THE INVENTION

It is one feature of this invention to provide a new combination of a water heater tank and a control device carried thereby, the control device having a shaft extension for the selector means thereof and being adapted to have a drive means thereof snap-fitted into a slot means of the selector knob of the control device.

In particular, it is well known that water heater tanks each comprise an inner wall means and an outer wall means containing insulating material therebetween, the control device for the electrically operated heating unit for the water heater tank being mounted against the inner wall so that the control knob of the selector means thereof faces toward the outer wall means. The space between the inner and outer walls of the water heater tank can be such that it is relatively difficult to provide means to reach the selector knob of the control device.

Therefore, it was found according to the teachings of this invention that a shaft extension could be uniquely attached to the selector knob of the control device so that the shaft extension would extend out through an opening through the outer wall and have another selector knob attached thereto so that the operator of the water heater tank could control the temperature setting of the control device externally to the outer wall of the water heater tank.

For example, one embodiment of this invention comprises a combination of a water heater tank having a heating means therefor, a control device carried by the tank and having operating means to sense the temperature of the tank and to operate the heating means in relation to the sensed temperature and a selected temperature of the control device, the control device having a housing means and having a temperature selector means rotatably carried by the housing means to set the selected temperature, the selector means comprising a knob provided with a transverse slot means therein, and a shaft extension having opposed ends one of which has drive means snap-fitted into the slot means so that the knob is adapted to be rotated upon the turning of the other of the ends of the shaft extension.

Therefore, it is an object of this invention to provide a new combination of a water heater tank and a control device carried thereby, the combination of this invention having one or more of the novel features of this invention as set forth above or hereinafter shown or described.

Another object of this invention is to provide a new method of making such a combination, the method of this invention having one or more of the novel features of this invention as set forth above or hereinafter shown or described.

Another object of this invention is to provide a new control device for such a combination, the control device of this invention having one or more of the novel features of this invention as set forth above or hereinafter shown or described.

Another object of this invention is to provide a new method of making such a control device, the method of this invention having one or more of the novel features of this invention as set forth above or hereinafter shown or described.

Another object of this invention is to provide a new shaft extension for such a control device, the shaft extension of this invention having one or more of the novel features of this invention as set forth above or hereinafter shown or described.

Another object of this invention is to provide a new method of making such a shaft extension, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENT

Figure 1:
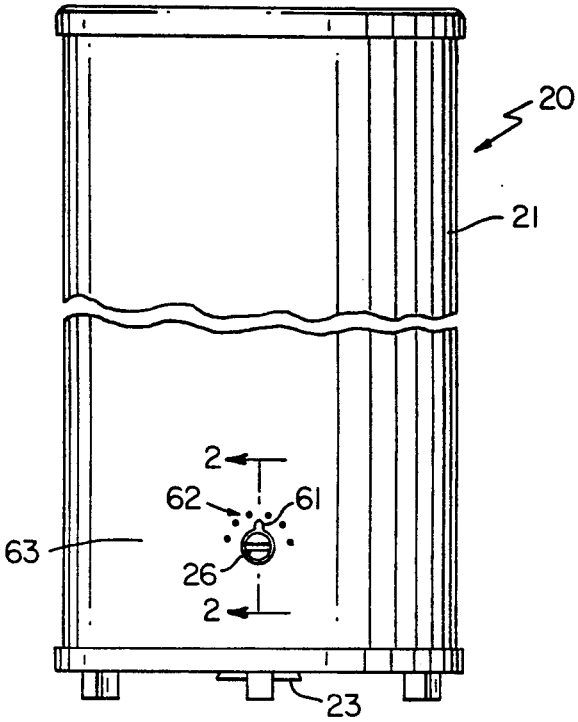
FIG. 1 is a front view of the new combination of the water heater tank and control device of this invention.
Figure 3:
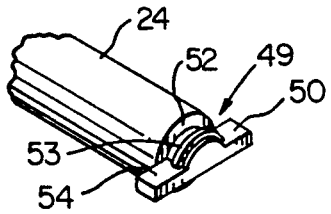
FIG. 3 is a fragmentary perspective view of one end of the shaft extension of the control device of this invention.

While the various features of this invention are hereinafter illustrated and described as being particularly adapted to provide an arrangement wherein the water in the water heater tank is heated by an electrically operated heater means, it is to be understood that the various features of this invention can be utilized singly or in various combinations thereof to provide a control device to be utilized with other types of heating means as desired.

Therefore, this invention is not to be limited to only the embodiment illustrated in the drawings, because the drawings are merely utilized to illustrate one of the wide variety of uses of this invention.

Figure 2:
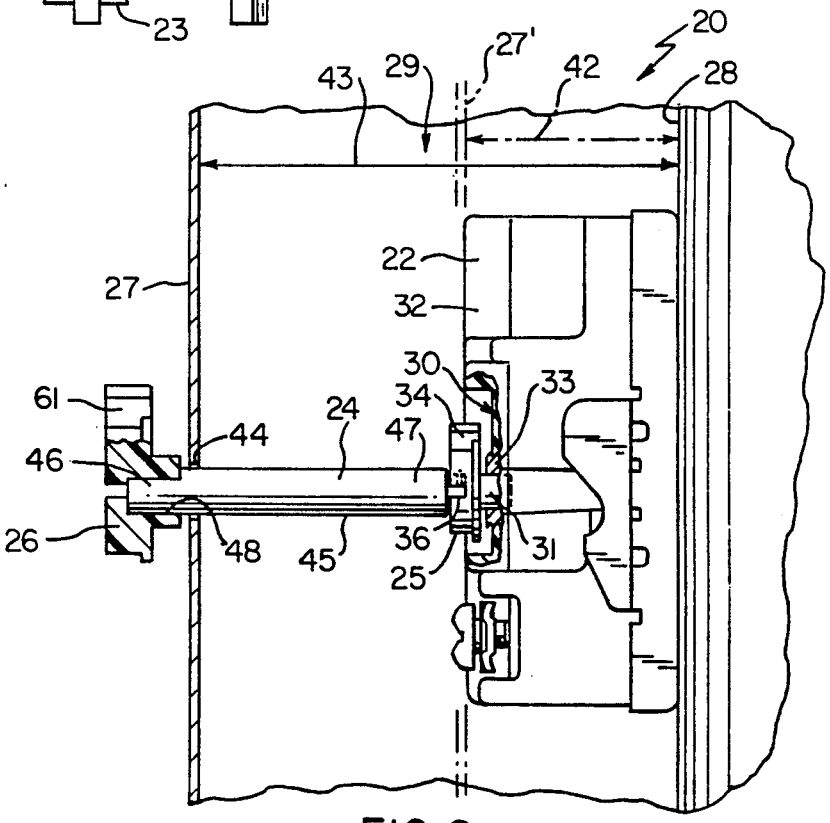
FIG. 2 is an enlarged fragmentary cross-sectional view taken on line 2—2 of FIG. 1.

Referring now to FIGS. 1 and 2, the new combination of this invention is generally indicated by the reference numeral 20 and comprises a water heater tank 21, a control device 22 for operating an electrically operated heater means 23 for the tank 21 and a shaft extension 24 that is interconnected to a selector knob 25 of the control device 22 and carries a control knob 26 that is accessible to an operator externally to an outer wall means 27 of the water heater tank 21.

In particular, the water heater tank 21 includes an inner wall means 28 which contains the water to be heated therein and which is spaced inwardly from the outer wall means 27 so that an annular chamber 29 is formed between the inner wall means 28 and the outer wall means 27 and in which suitable insulation (not shown) is disposed to tend to prevent a heat loss from the heated water that is contained within the inner wall means 28 of the tank 21 in a manner well known in the art.

The control device 22 is mounted against the internal wall means 28 and has operating means that is generally indicated by the reference numeral 30 to sense the temperature of the wall means 28 and to operate the heating means 23 in relation to the sensed temperature and a selected temperature of the control device 22 that is selected by a temperature selector means 31 that is rotatably carried by a housing means 32 of the control device 22 in a manner well known in the art. For example, see the aforementioned U.S. Pat. to McIntosh, No. 4,633,211 whereby this patent is being incorporated into this disclosure by this reference thereto.

Figure 4:
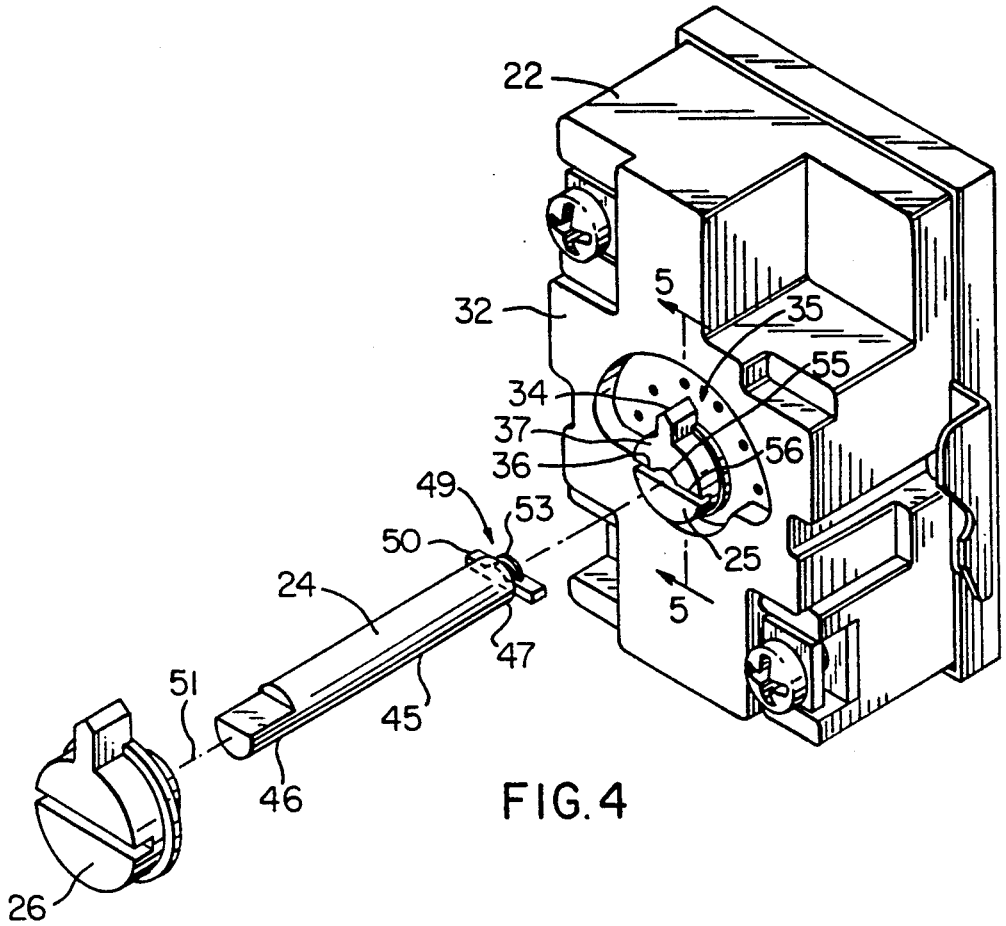
FIG. 4 is an exploded perspective view of the shaft extension and the control device of this invention.

Since the control device 22 of this invention is substantially the same as the control device set forth in the aforementioned U.S. Pat. to McIntosh, No. 4,633,211, a discussion of the details of the structure and the operation thereof is deemed unnecessary except to state that the selector means 31 normally comprises the control knob 25 fixed on a selector shaft 33 rotatably carried by a housing means 32 of the control device 22 and having a pointer arrangement 34, FIG. 4, movable relative to a scale means 35 on the housing means 32 to permit a user to select the desired selected temperature that the control device 22 is to tend to maintain through the operation of the heater means 23, the control knob 25 having a transverse slot means 36 interrupting a front face 37 thereof while having an externally splined projection 38 extending from a rear face 39 thereof and being press fitted into an internally splined opening 40 formed in a free end 41 of the selector shaft 33 as illustrated in FIG. 4.

Thus, should it be desired that the heating means 23 for the water heater tank 21 is to tend to maintain the temperature of the water therein at approximately 140° F., the operator turns the selector knob 25 to the 140° F. setting position thereof and the operating means 30 therein will turn on the heating means 23 when the sensed temperature thereof falls to or below the selected temperature of 140° F. and turns off the heating means 23 when the sensed temperature of the control device 22 rises to or above the selected temperature of 140° F.

Because the housing means 32 of the control device 22 has a certain thickness, as provided by the dimensional arrow means 42 in FIG. 2, the control knob 25 would be readily externally accessible to an external wall of the water heater tank 21 if the external wall was disposed at the conventional distance 42 from the inner wall 28 as represented by dashed lines 27' in FIG. 2. However, the exterior wall 27 of the water heater tank 21 may be disposed at greater distances from the inner wall 28 and, thus, from the control knob 32 such as represented by the exterior wall 27 that is disposed the distance 43 from the inner wall 28 whereby it is relatively difficult to reach the control knob 25 even though an access opening is cut in the exterior wall 27 and provided with a door means thereon.

Therefore, it is desirable to provide a shaft extension means to the control device 22 and which would permit the control knob 26 to be accessible at the exterior of the wall means 27 to control the temperature setting of the control device 22.

Accordingly, the unique shaft extension 24 of this invention is provided which will not only operate the control knob 25 to set the same upon the turning of the exterior control knob 26, but also the shaft extension 24 is so uniquely attached to the control knob 25 in a manner hereinafter set forth that the shaft extension 24 is adapted to pass through an opening 44 through the exterior wall 27 that is intended to be aligned with the control knob 25 but permits the shaft extension 24 to wobble relative to the control knob 25 to allow for misalignment of the opening 44 with the control knob 25 while still permitting the shaft extension 24 to be in driving relation with the control knob 25. In addition, the shaft extension 24 of this invention readily permits the same to be separated from the control knob 25 should someone accidentally pull outwardly on the shaft extension 24 with too great a force whereby such shaft extension 24 will separate from the control knob 25 before the control device 22 is damaged by such outward pulling force as will be apparent hereinafter.

The shaft extension 24 of this invention comprises a generally cylindrical rod-like part 45 formed of any suitable material, such as metallic material, and having opposed ends 46 and 47. The end 46 of the part 45 is formed in a D shape to be received in a D-shaped opening 48 in the control knob 26 so that the control knob 26 can be fastened thereon in driving relation therewith, such as through a press-fit arrangement or the like, and will cause the part 45 to rotate in unison with rotation of the knob 26 in a manner well known in the D-shaft art.

The other end 47 of the rod 45 defines a driving means 49 that comprises an elongated part 50 that has a generally rectangular cross-sectional configuration and is disposed substantially transverse to the rotational axis 51 of the shaft extension 24 when the shaft extension 24 is disposed in place in the manner illustrated in FIGS. 2 and 4.

The part 50 of the shaft extension 24 extends from a substantially flat end surface 52 at the end 47 of the part 45 and has an upstanding projection 53 on the surface 54 thereof, the projection 53 being semicircular in configuration and being spaced from the flat end surface 52 in parallel relation thereto as illustrated.

Figure 5:
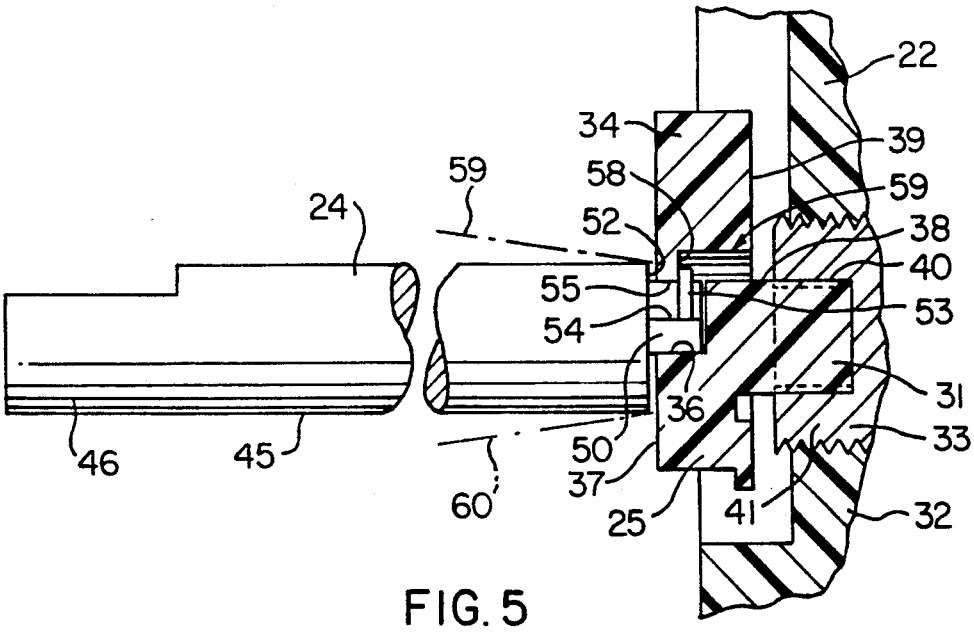
FIG. 5 is an enlarged fragmentary cross-sectional view taken on line 5—5 of FIG. 4 with the shaft extension having been snap-fitted to the control knob of the control device.

The transverse slot means 36 in the face 37 of the control knob 25 has a semicircular central part 55 in a front section 56 of the slot means 36, the front section 56 joining with an interior section 57 thereof that cooperates therewith to define an internal shoulder 58 as illustrated in FIG. 5.

The sections 56 and 57 of the slot means 36 are so constructed and arranged relative to the projection 53 and elongated part 50 of the drive means 49 of the shaft extension 24 that the projection 53 is adapted to be forced through the slot means 36 at the central semicircular portion 55 thereof to snap beyond the shoulder 58 and be received in the slot section 57 in the manner illustrated in FIG. 5 while the elongated part 50 is received in the slot section 56 of the slot means 36. Such snap-fitting relationship is provided by forming the knob 25 from plastic material and the rod 35 from substantially rigid material so that the knob 25 will deform sufficiently to permit the projection 53 to be received in the slot section 57 of the slot means 36 and thereafter permit the control knob 25 to undeform into the arrangement illustrated in FIG. 5 wherein the projection 53 is disposed behind the shoulder 58. When the projection 53 is disposed against the shoulder 58 in the manner illustrated in FIG. 5, it can be seen that the end surface 52 of the rod 45 is slightly spaced outwardly from the front face 37 of the control knob 25 and the part 50 is slightly loose in the section 56 so as to permit the rod 45 to wobble or swivel in its interconnected relation with the knob 25, such as represented by the dashed wobble lines 59 and 60 of FIG. 5 and thereby permit the other end 46 of the rod 45 to be disposed through a misaligned opening 44 of the outer wall means 27 in the manner illustrated in FIG. 2.

Nevertheless, when the drive means 49 of the shaft extension 24 has been snap-fitted into the slot means 36 of the control knob 25 in the manner previously set forth, the elongated part 50 of the drive means 49 will cause the knob 25 to rotate in unison with the rotation of the shaft part 45 by the knob 26 so that the knob 25 will be set to a selected position determined by a pointer 61 of the knob 26 being positioned relative to a scale 62 on the exterior surface 63 of the outer wall 27 of the water heater tank 21 in the manner illustrated in FIG. 1.

Should someone pull outwardly on the shaft extension 24 at the end 46 thereof, the driving means 49 will unsnap from the slot means 36 and thereby permit the shaft extension 24 to be pulled outwardly from the opening 44 long before such pulling force will adversely damage the control device 22 so that once the shaft extension 24 has been separated therefrom, a repairman can readily replace the removed shaft extension 24 and may not need to repair the control device 22 as the same may not have been damaged by such separation force.

Therefore, it can be seen that it is a relatively simple method of this invention to mount the control device 22 to the inner wall 28 of the water heater tank 21 in a conventional manner, snap fit the drive means 49 of the shaft extension 24 into the slot means 36 of the control knob 25 in the manner previously set forth with the projection 53 readily aligning with the semicircular central portion 55 of the slot means 36 so that the D-shaped end 46 will accept the control knob 26 in the proper position so that the pointer 61 of the control 26 is in alignment with the pointer means 34 of the control knob 25 through the relationship of the D shape of the end 46 with the projection 53. The shaft extension 24 is inserted through the opening 44 so that the driving end 49 can be snap-fitted in place and then the control knob 26 can be disposed on the end 46 of the shaft extension 24 at the exterior of the wall 27 of the water heater tank 21 so that the shaft extension 24 can perform the temperature setting functions in the manner previously set forth by merely turning the control knob 26.

Therefore, it can be seen that this invention not only provides a new combination of a water heater tank and a control device therefor as well as a new method of making the same, but also this invention provides a new control device for such a combination and a new shaft extension for such a control device or the like.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In the combination of a water heater tank having a heating means therefor, and a control device carried by said tank and having operating means to sense the temperature of said tank and to operate said heating means in relation to said sensed temperature and a selected temperature of said control device, said control device having a housing means and having a temperature selector means rotatably carried by said housing means to set said selected temperature, said selector means comprising a first knob provided with a transverse slot means therein and being the part in some applications thereof that is manually grasped by an operator for setting said selected temperature, the improvement comprising a shaft extension having opposed ends one of which has drive means snap-fitted into said slot means so that said first knob is adapted to be rotated upon the turning of the other of said ends of said shaft extension, and a second knob secured to said other of said ends of said shaft extension.

2. A combination as set forth in claim 1 wherein said slot means of said first knob and said drive means of said shaft extension provide a swivel connection therebetween so that said shaft extension can wobble relative to said first knob while still providing a driving relation therewith.

3. A combination as set forth in claim 2 wherein said water heater tank has an inner wall means and an outer wall means spaced from said inner wall means, said control device being mounted against said inner wall means with said first knob thereof facing and being spaced inwardly from said outer wall means, said outer wall means having an opening therethrough that is generally aligned with said first knob, said extension shaft projecting through said opening, and said second knob being disposed outboard of said outer wall.

4. A combination as set forth in claim 1 wherein said drive means of said shaft extension comprises an elongated part disposed transverse to the axis of rotation of said shaft extension.

5. A combination as set forth in claim 4 wherein said elongated part of said shaft extension has a projection thereon for snap-fitting to said first knob.

6. A combination as set forth in claim 5 wherein said slot means of said first knob has a first section that receives said elongated part of said shaft extension therein and has a second part that defines an internal shoulder means of said first knob and receives said projection of said shaft extension therein with a portion of said projection being disposed behind said internal shoulder means.

7. In the method of making a combination of a water heater tank having a heating means therefor, and a control device carried by said tank and having operating means to sense the temperature of said tank and to operate said heating means in relation to said sensed temperature and a selected temperature of said control device, said control device having a housing means and having a temperature selector means rotated carried by said housing means to set said selected temperature, said selector means comprising a first knob provided with a transverse slot means therein and being the part in some applications thereof that is manually grasped by an operator for setting said selected temperature, the improvement comprising the steps of forming a shaft extension to have opposed ends one of which has drive means snap-fitted into said slot means so that said first knob is adapted to be rotated upon the turning of the other of said ends of said shaft extension, and securing a second knob to said other of said ends of said shaft extension.

8. A method as set forth in claim 7 and including the step of forming said slot means of said first knob and said drive means of said shaft extension to provide a swivel connection therebetween so that said shaft extension can wobble relative to said first knob while still providing a driving relation therewith.

9. A method as set forth in claim 8 and including the steps of forming said water heater tank to have an inner wall means and an outer wall means spaced from said inner wall means, mounting said control device against said inner wall means with said first knob thereof facing and being spaced inwardly from said outer wall means, forming said outer wall means to have an opening therethrough that is generally aligned with said first knob, projecting said shaft extension through said opening, and attaching said second knob to said other end of said shaft extension so as to be disposed outboard of said outer wall.

10. A method as set forth in claim 7 and including the step of forming said drive means of said shaft extension to comprise an elongated part disposed transverse to the axis of rotation of said shaft extension.

11. A method as set forth in claim 10 and including the step of forming said elongated part of said shaft extension to have a projection thereon for snap-fitting to said first knob.

12. A method as set forth in claim 11 and including the step of forming said slot means of said first knob to have a first section that receives said elongated part of said shaft extension therein and to have a second part that defines an internal shoulder means of said first knob that receives said projection of said shaft extension therein with a portion of said projection being disposed behind said internal shoulder means.

* * * * *